United States Patent [19]

Furuyama

[11] Patent Number: 4,961,412

[45] Date of Patent: Oct. 9, 1990

[54] AIR-FUEL RATIO CONTROL SYSTEM FOR AN AUTOMOTIVE ENGINE

[75] Inventor: Masaaki Furuyama, Hohya, Japan

[73] Assignee: Fuji Jukogyo Kabushiki Kaisha, Tokyo, Japan

[21] Appl. No.: 395,963

[22] Filed: Aug. 18, 1989

[30] Foreign Application Priority Data

Aug. 31, 1988 [JP] Japan ..... 63-218994

[51] Int. Cl.[5] ..... F02M 39/00

[52] U.S. Cl. ..... 123/520; 123/357

[58] Field of Search ..... 123/518, 519, 520, 521, 123/357, 358, 359

[56] References Cited

U.S. PATENT DOCUMENTS

| | | | |
|---|---|---|---|
| 4,407,769 | 8/1984 | Matsumura | 123/520 |
| 4,566,068 | 1/1986 | Iwasaki | 123/357 |
| 4,630,581 | 12/1986 | Shibata | 123/519 |
| 4,641,623 | 2/1987 | Hamburg | 123/518 |
| 4,809,667 | 3/1989 | Uranishi | 123/518 |
| 4,817,576 | 4/1989 | Abe | 123/519 |
| 4,821,701 | 4/1989 | Nankee, III | 123/520 |
| 4,841,940 | 6/1989 | Uranishi | 123/520 |
| 4,867,126 | 9/1989 | Yoiuekawa | 123/520 |

FOREIGN PATENT DOCUMENTS

| | | | |
|---|---|---|---|
| 0065244 | 4/1985 | Japan | 123/520 |
| 60-93150 | 5/1985 | Japan . | |
| 61-112755 | 5/1986 | Japan . | |

*Primary Examiner*—Carl Stuart Miller

*Attorney, Agent, or Firm*—Martin A. Farber

[57] ABSTRACT

An automotive engine has a purge system for purging fuel vapor in a canister to an intake passage of the engine, and a learning control system. Fuel injection pulse width is determined by using a learning coefficient derived from learning memory. The learning memory stores a plurality of learning coefficients which are updated with change of characteristics of elements of the engine. When the purge starts, the learning coefficients stored in the learning memory are stored in an updating memory as updating coefficients. When the purge is cut off, the learning coefficients in the learning memory are updated with updating coefficients in the updating memory.

3 Claims, 11 Drawing Sheets

AIR-FUEL RATIO CONTROL SYSTEM FOR AN AUTOMOTIVE ENGINE

BACKGROUND OF THE INVENTION

The present invention relates to an air-fuel ratio control system for an automotive engine provided with a carbon canister, and more particularly to a system having an electronic fuel injection system controlled by a learning system.

In one type of electronic fuel injection control disclosed in Japanese Patent Application Laid-Open 60--93150, the quantity of fuel to be injected into the engine is determined in accordance with engine operating variables such as mass air flow, intake-air pressure, engine load and engine speed. The quantity of fuel is determined by a fuel injector energization time (injection pulse width).

Generally, a desired injection quantity is obtained by correcting a basic quantity of injection with various correction or compensation coefficients of engine operating variables. The basic injection pulse width $T_p$ is expressed, for example, as follows.

$$T_P = K \times Q/N$$

where Q is the mass air flow, N is the engine speed and K is a constant.

Desired injection pulse width $T_i$ is obtained by correcting the basic injection pulse $T_P$ with coefficients for engine operating variables. The following is an example of an equation for computing the actual injection pulse width.

$$T_i = T_p \times COEF \times \alpha \times K_L + T_s$$

where COEF is a miscellaneous coefficient comprising various correction or compensation coefficients obtained from memories dependent on coolant temperature and throttle position, $\alpha$ is a air-fuel ratio correcting coefficient which is obtained from the output of an $O_2$-sensor provided in an exhaust passage, and $K_L$ is a correcting coefficient by learning (hereinafter called learning coefficient) for compensating the change of characteristics of devices with time in the fuel control system such as, injectors, air flow meter and pressure regulator, due to deterioration thereof, $T_s$ is a constant for compensating voltage. The coefficient $K_L$ are stored in a lookup table provided in a non-volatile RAM in a microcomputer, and a necessary coefficient is derived from the table in accordance with sensed informations. The learning is executed in steady states of the engine operation. In order to detect the steady state, an operation matrix comprising a plurality of divisions is provided. The column and row of the matrix represent engine operating conditions such as engine speed N and basic injection pulse width $T_P$ and each division is designated magnitudes of engine speed and pulse width. When the magnitudes of the engine operating conditions continue for a period of time within one of divisions, it is determined that the engine is in a steady state. In such a steady =state, the learning operation is executed. In the learning, the learning coefficient $K_L$ corresponding to the engine operating conditions is rewritten with a new coefficient which is obtained by incrementing or decrementing the coefficient with a value relative to the feedback signal from the $O_2$-sensor.

The learning starts when the output of the $O_2$-sensor changes cyclically, over a reference value for dividing a rich side and lean side, a predetermined number of times (three times) while the magnitudes of the engine operating conditions stay in one of the divisions in the matrix.

On the other hand, the engine is provided with a carbon canister for absorbing the fuel vapor in a fuel tank during the time when the engine is not running, and for purging the fuel vapor from the canister to an intake manifold in predetermined conditions of the engine operation. When the fuel in the canister is purged, the fuel vapor is added to the air-fuel mixture induced in cylinders of the engine, rendering the mixture rich.

When the vehicle is driven where the atmospheric temperature is high, or at high altitude, or when gasoline having a high vapor-pressure is used, a large amount of fuel vapor is generated. Consequently, when the canister is purged, the air-fuel ratio becomes excessively rich. Accordingly, the air-fuel ratio control system operates to dilute the rich mixture in accordance with the feedback signal of the $O_2$-sensor. Namely, the air-fuel ratio correcting coefficient $\alpha$ is set to a minimum value. At the same time the learning coefficient $K_L$ is updated so as to converge the output of the $O_2$-sensor on 1.0. Thus, the air-fuel ratio is maintained at a stoichiometric air-fuel ratio by extremely small amount of fuel. Under such a condition, when the throttle valve is closed at idling, the purge is cut off. Accordingly, the air-fuel mixture induced in cylinders immediately becomes lean. The learning control system operates to enrich the mixture by increasing the learning coefficient in response to the output of the $O_2$-sensor. However, since the learning coefficients are rewritten little by little, the air-fuel mixture stays lean for some time, which will cause malfunction of the engine.

Japanese Patent Application Laid-Open 61-112755 discloses a system where two learning coefficient tables are provided to solve such a problem. The learning coefficients are derived from the first table when the fuel vapor is purged from the canister and from the second table when the purge is cut off. However, in order to provide two tables, the capacity of a back-up RAM must be increased. In addition, the operation becomes complicated as that a microcomputer having a large capacity must be provided, thereby causing increase of the cost for manufacturing the control system.

SUMMARY OF THE INVENTION

The object of the present invention is to provide a learning control system which may prevent the air-fuel mixture from temporarily becoming extremely lean when the purge of the fuel vapor in the canister is stopped and to provide a learning control system which may be manufactured at low cost without increasing the capacity of a memory.

According to the present invention, there is provided an air-fuel ratio control system for an automotive engine, the engine having a purge system for purging fuel vapor in a canister to an intake passage of the engine, and a learning control system having a first memory storing a plurality of learning coefficients which are used for determining air-fuel ratio of a mixture and updating means for updating the learning coefficients with change of characteristics of elements of the engine.

The system comprises first detector means for detecting a start and a stop of the purging of the fuel vapor and for producing a purge start signal and a purge cut signal respectively, storing means responsive to the purge start signal for storing the learning coefficients stored in the first memory in a second memory as updating coefficients, second detector means responsive to the purge start signal for detecting a large amount of purged fuel vapor and for producing an updating signal, and updating means responsive to the purge cut signal and to the updating signal for updating the learning coefficients in the first memory with the updating coefficients in the second memory.

In an aspect of the present invention, the learning coefficient is updated with an average of a learning coefficient in first memory and an updating coefficient in the second memory.

In another aspect of the invention, the second detector means detects a large deviation of the learning coefficient in the first memory.

The other objects and features of this invention will be apparently understood from the following description with reference to the accompanying drawings

DETAILED DESCRIPTION OF THE PREFERRED EMBODIMENTS

Figure 1A:
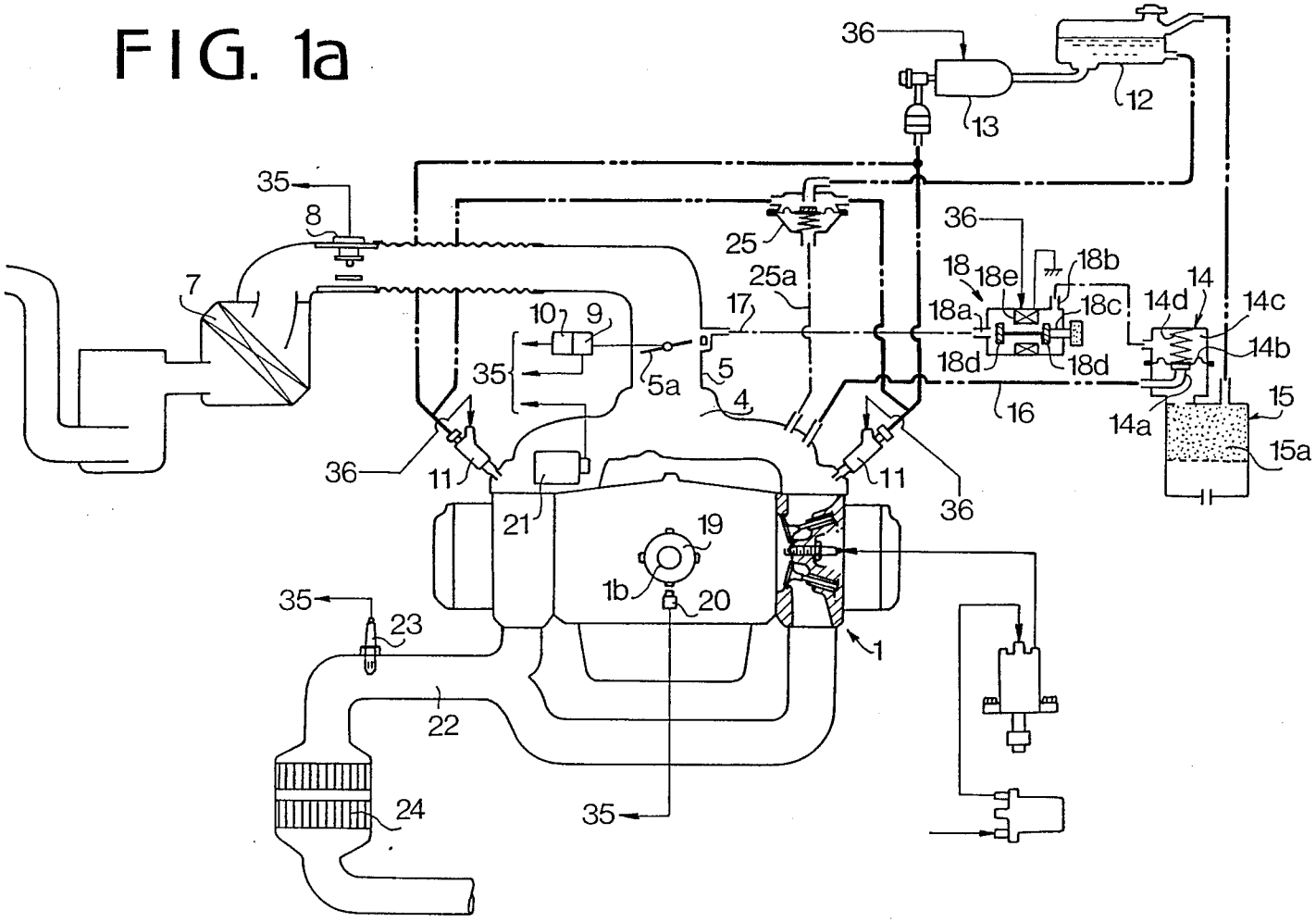
FIGS. 1*a* and 1*b* show a schematic diagram of a system of the present invention.
Figure 1B:
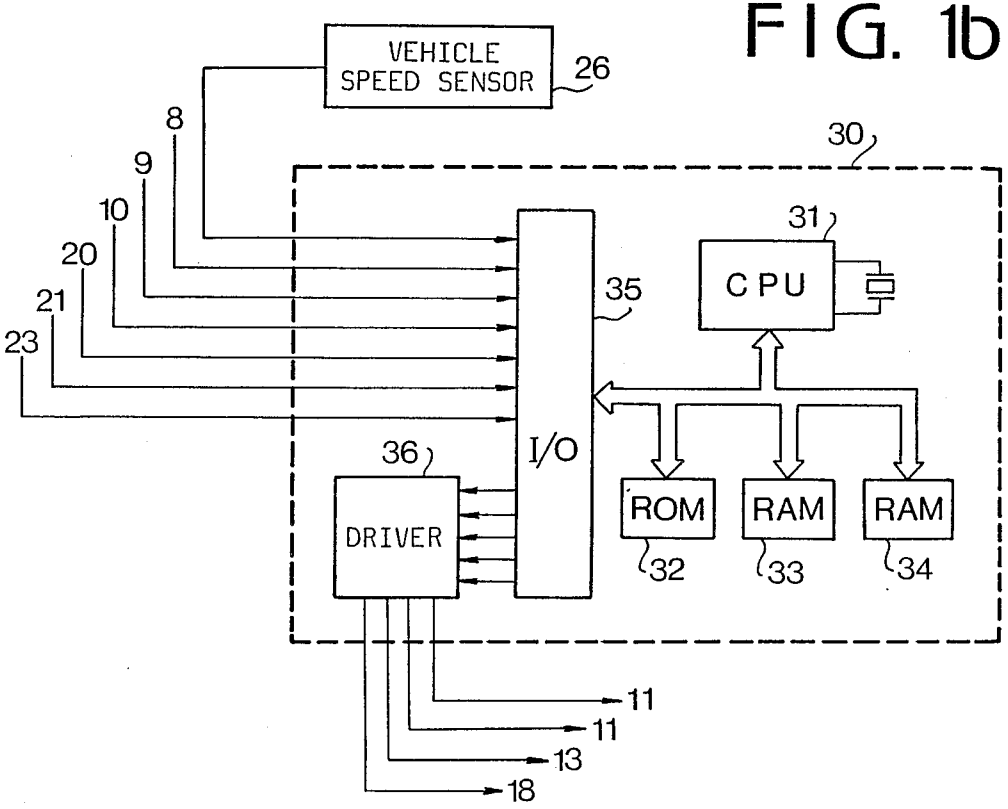

Referring to FIGS. 1*a* and 1*b*, an engine 1 has an intake passage 5, a throttle valve 5*a*, and an intake manifold 4 which is communicated with combustion chambers of the engine. In an intake system, an air cleaner 7 and an air flow meter 8 comprising a hot wire are provided. In an exhaust pipe 22, a catalytic converter 24 and an $O_2$-sensor 23 are provided. Fuel is supplied to fuel injectors 11 from a fuel tank 12 by a fuel pump 13, and returned to the tank 12 through a pressure regulator 25 which is opened by intake manifold pressure applied through a pipe 25*a*. A coolant temperature sensor 21 is mounted in the engine 1 for detecting the temperature of coolant. A throttle position sensor 9 and an idle switch 10 are attached to the intake passage 5.

The idle switch 10 is closed when the throttle valve 5*a* is substantially closed or positioned at a minimum degree On a crankshaft 1*b* of the engine 1 is secured a crankshaft disk 19 having projection or slits on the periphery thereof. A crank angle sensor 20 (magnetic pickup) is provided adjacent the crankshaft disk 19 so as to detect the positions of the projections. A vehicle speed sensor 26 is provided for producing a vehicle speed signal.

A body 15*a* of a carbon canister 15 has ports communicated with the fuel tank 12 and a purge valve 14. The purge valve 14 comprises a pipe 14*a* having an opening at the upper end thereof, a diaphragm 14*b* defining a vacuum chamber 14*c*, and a spring 14*d* urging the diaphragm to the pipe 14*a* to close the opening. The pipe 14*a* is communicated through a purge line 16 to the intake manifold 4. The vacuum chamber 14*c* is communicated with the intake passage 5 through a solenoid operated control valve 18.

The solenoid operated control valve 18 comprises a port 18*a* communicated through a line 17 to the intake passage 5 at positions upstream and downstream of the throttle valve 5*a*, a port 18*b*communicated with the vacuum chamber 14*c*, a pipe 18*c* communicated with the atmosphere, a valve body 18*d* axially slidably provided in the housing, and a solenoid 18*e*. When the solenoid 18*e* is excited, the valve body 18*d* is shifted to the right to open the port 18*a* to communicate the vacuum chamber 14*c* with the intake passage 5. Accordingly, the diaphragm 14*b* is lifted by vacuum, thereby opening the pipe 14*a*. As a result, fuel vapor is purged into the intake manifold 4 through the purge line 16. When the solenoid 18*e* is de-energized, the port 18*a* is closed to open the pipe 18*c*, thereby communicating the vacuum chamber 14*c* with the atmosphere.

An electronic control system 30 comprises a central processor unit (CPU) 31, a read only memory (ROM) 32, a random access memory (RAM) 33, a non-volatile RAM 34 and an input/output (I/O) interface 35. Programs and data for controlling the engine are stored in the ROM 32. A learning coefficient table which will later be described is stored in the RAM 34.

The I/O interface 35 is applied with a coolant temperature signal $T_W$ from the coolant temperature sensor 21, an air-fuel ratio feedback signal $\lambda$ from the $O_2$-sensor 23, an intake air quantity signal from the air flow meter 8, an idling signal from the idle switch 10, a throttle valve opening degree signal 8 from the throttle position sensor 9, a crank angle signal from the crank angle sensor 20 and a vehicle speed S from the vehicle speed sensor 26. These signals are stored in the RAM 33 after processing data in accordance with the program stored in the ROM 32. The CPU 31 produces respective control signals, which are applied to a driver 36 through the I/O interface 35. The driver 36 produces signals for controlling fuel injectors 11, fuel pump 13, ignition coils, and the solenoid operated control valve 18.

Figure 2A:
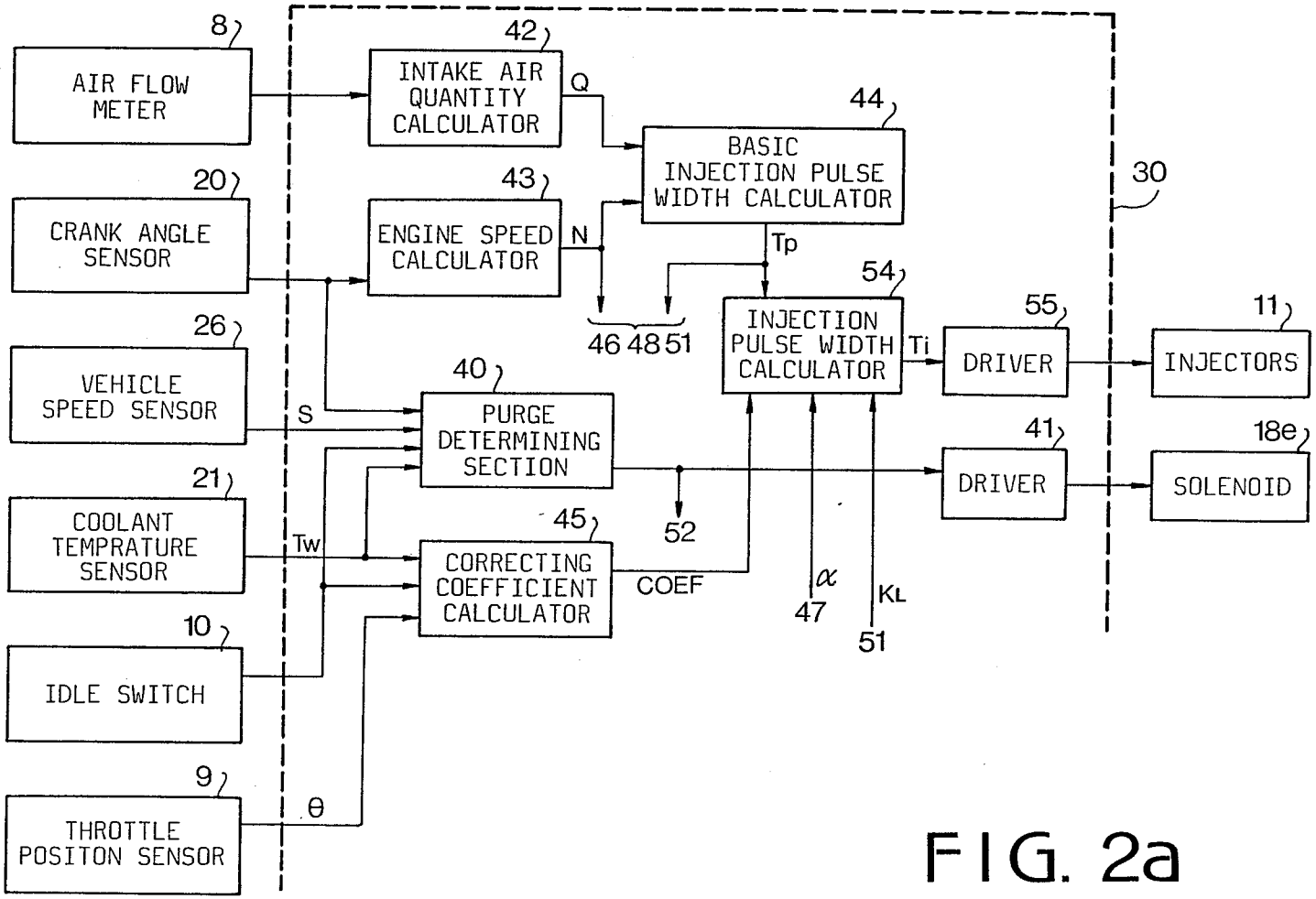
FIGS. 2*a* and 2*b* show a block diagram showing a control unit.
Figure 2B:
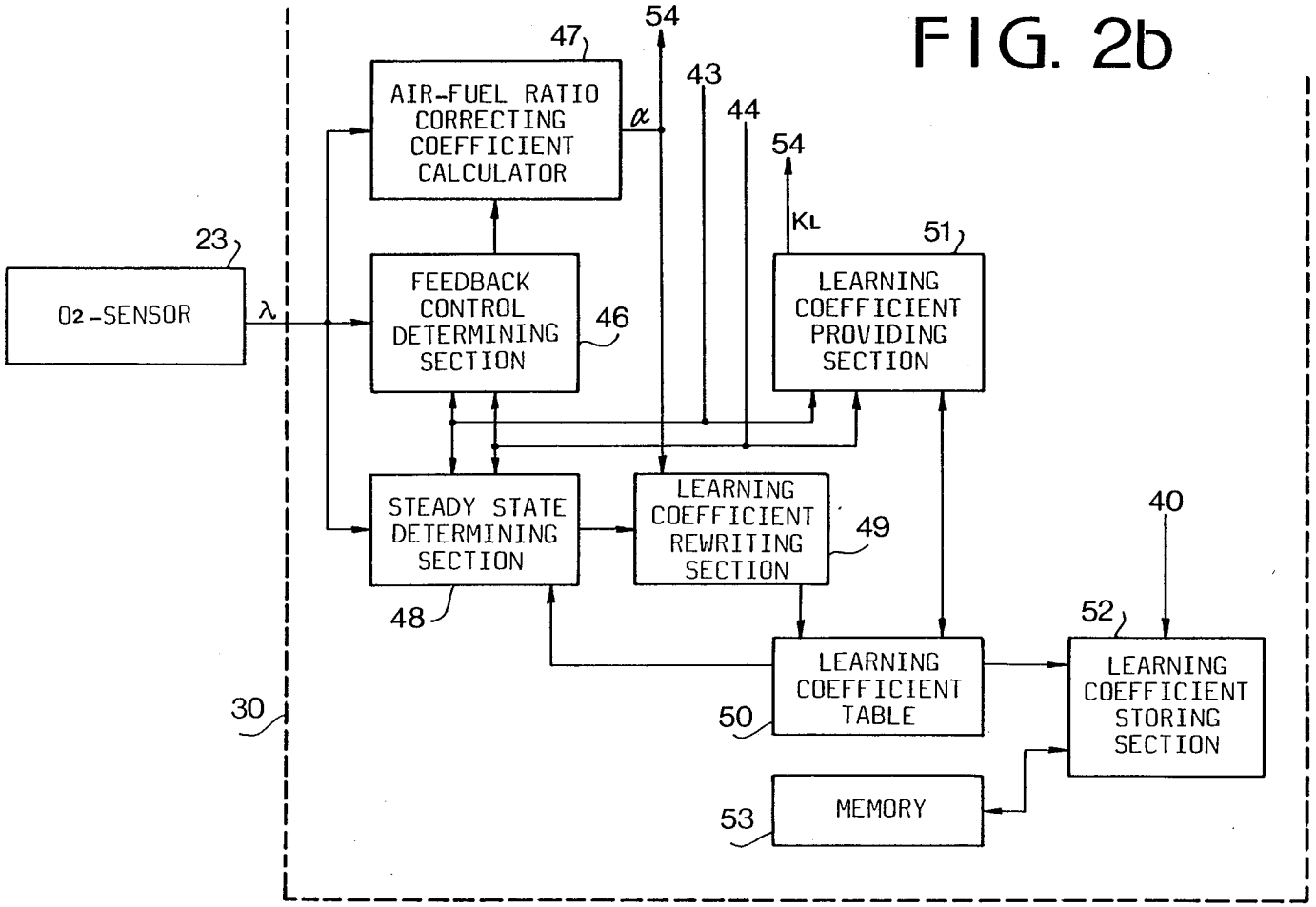

Referring to FIGS. 2*a* and 2*b* showing a system for controlling the air-fuel ratio, the control unit 30 has a purge determining section 40 to which output signals from the vehicle speed sensor 8, crank angle sensor 20, coolant temperature sensor 21 and idle switch 10 are fed. In a steady state after the engine 1 is operated for more than a predetermined period T, for example, 3 seconds, and where coolant temperature $T_W$ is higher than a predetermined reference value $T_{WO}$, for example 65° C. and vehicle speed S is higher than a predetermined reference speed $S_O$ and the idle switch 10 is turned off, a canister purge signal is applied from the section 40 to the solenoid 18*e* of the control valve 18 through a driver 41 to energize it. Thus, the fuel vapor is purged from the carbon canister On the other hand, when the engine 1 is idling, or when it is within the period T from the start of the engine or the coolant temperature $T_W$ or the vehicle speed S are lower than the values $T_{WO}$ and $S_O$, the section 40 produces a purge cut signals, so that the solenoid 18*e* is de-energized to close the valve 14, thereby cutting off the purge.

The control unit 30 further comprises an intake air quantity calculator 42 which calculates an intake air quantity Q dependent on the intake air quantity signal from the air-flow meter 8 and an engine speed calculator 43 which calculates an engine speed N dependent on a crank angle sensor 20.

The intake air quantity Q and engine speed N are fed to a basic injection pulse width calculator 44. The calculator 44 produces a basic injection pulse width $T_P$ in dependency in the following equation.

$$T_P = K \times Q/N \text{ (K is a constant)}$$

A correcting coefficient calculator 45 is applied with the throttle opening degree $\theta$ from the throttle position sensor 9, the coolant temperature $T_W$ from the coolant temperature sensor 21 and the idling signal from the idle switch 10 to calculate a miscellaneous correcting coefficient COEF for correcting the injection pulse width with respect to acceleration, engine temperature, wide-open throttle and idling.

Figure 3:
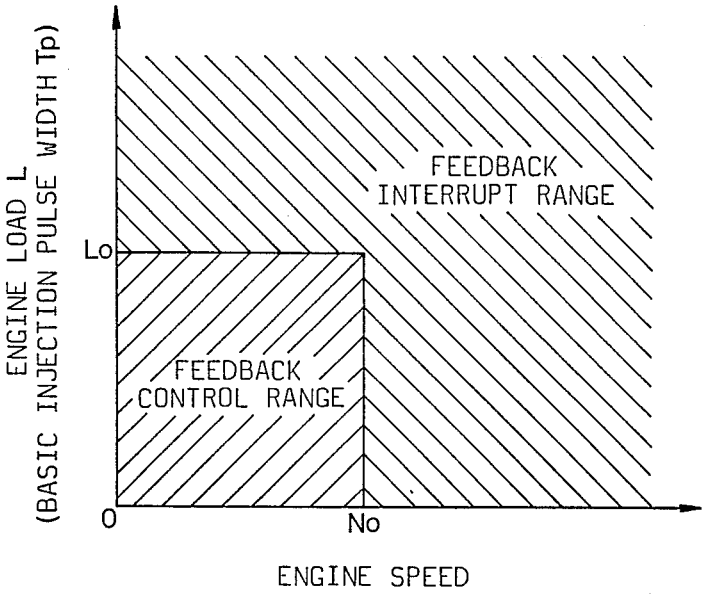
FIG. 3 is a graph showing a feedback control range in relation to engine load and engine speed.

The air-fuel feedback signal $\lambda$ from the $O_2$-sensor 23 is applied to an air fuel ratio correcting coefficient calculator 47. In the calculator 47, an actual air-fuel ratio dependent on the feedback signal $\lambda$ and the difference between the actual air-fuel ratio and the stoichiometric air-fuel ratio are calculated to obtain an air-fuel ratio correcting coefficient $\alpha$ for correcting the difference. When the engine is warmed up and the $O_2$-sensor 23 becomes activated, an integral of the output voltage of the $O_2$-sensor at a predetermined time is provided as the value of $\alpha$. More particularly, the computer has a function of an integrator, so that the output voltage of the $O_2$-sensor is integrated. FIG. 5b shows the output of the integrator. The system provides values of the integration at a predetermined interval. For example, in FIG. 5b, integrals $I_1$, $I_2$—at times $T_1$, $T_2$—are provided as coefficient $\alpha$. Accordingly, the amount of fuel is controlled in accordance with the feedback signal from the $O_2$-sensor, which is represented by integral. A feedback control determining section 46, to which the feedback signal $\lambda$, engine speed N and the basic injection pulse width $T_P$ as an engine load L are fed, is provided in the control unit 30 to determine whether the feedback control is to be carried out or not. The determining section 46 applies a feedback control interrupting signal to the correction coefficient calculator 47 when the output voltage of the $O_2$-sensor 23 is low, which means the $O_2$-sensor is inactivated because of low temperature of the body of the $O_2$-sensor 23 is low. Moreover, the interrupting signal is fed when the engine speed N is higher than a predetermined reference speed $N_O$, for example 4500 rpm, or when the engine load L represented by the basic injection pulse width $T_p$ is higher than a predetermined reference load $L_O$. An engine operating range wherein the feedback control is interrupted is shown in a graph of FIG. 3. Thus, the feedback control is interrupted when the output voltage of the $O_2$-sensor is unstable such as at the start of the engine or at wide-open throttle When the feedback interrupting signal is fed, the calculator 47 is adapted to produce the correcting coefficient $\alpha$.

The control unit 30 further has a system for correcting the basic injection pulse width $T_P$ by learning in order to compensate the change of characteristics of devices with time in the fuel control system.

The engine load L and the engine speed N are fed to a learning coefficient providing section 51 which derives a learning coefficient $K_L$ stored in a learning coefficient table 50 in the RAM 34.

Figure 5A:
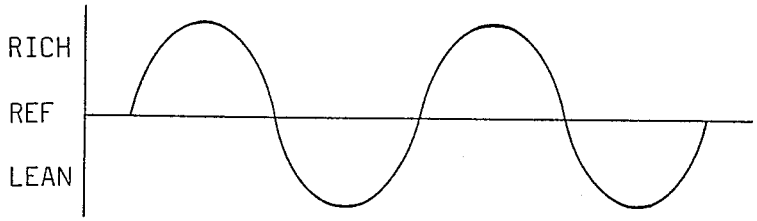
FIG. 5*a* shows the output voltage of the an $O_2$-sensor.
Figure 5B:
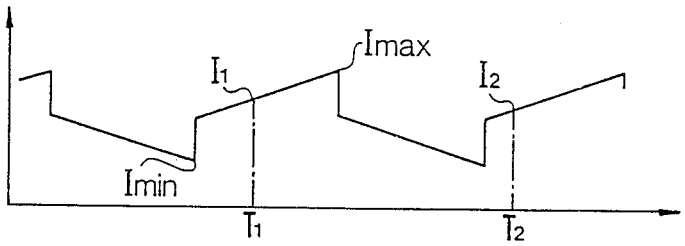
FIG. 5*b* shows the output voltage of an integrator.

On the other hand, the output voltage of the $O_2$-sensor 23 cyclically changes through a reference voltage corresponding to a stoichiometric air-fuel ratio, as shown in FIG. 5a. Namely, the voltage changes between high and low voltages corresponding to rich and lean air-fuel mixtures. In the system, when the output voltage (feedback signal $\lambda$) of the $O_2$-sensor continues during n cycles, for example three cycles, within one of the divisions in the matrix, the engine is assumed to be in steady state under the engine operating condition determined by the division An output signal of the steady state determining section 48 is applied to a learning coefficient rewriting section 49 to which the air-fuel ratio feedback correcting coefficient $\alpha$ is fed. When the steady state of engine operation is detected, the learning coefficient table 50 is updated with a value relative to the feedback signal from the $O_2$-sensor. The first updating is done with an arithmetical average A of maximum value and minimum value in one cycle of the integration, for example values of Imax and Imin of FIG. 5b. Thereafter, a new learning coefficient $K_L'$ is calculated by the following equation.

$$K_L' = K_L + \Delta A/M$$

where $\Delta A$ is a difference between the average A and a desired value $\alpha\lambda(=1)$ of the feedback control as a reference value ($\Delta A = A - \alpha\lambda$), and M is a constant. Thus, when the value of $\alpha$ is not 1, the table 50 is incremented or decremented by a minimum value $\Delta A/M$.

In accordance with the present invention, a learning coefficient storing section 52, to which the canister purge signal from the purge determining section 40 is applied is provided in the control unit 30 so as to correct the learning coefficient when the purge is carried out. Learning coefficients $K_L$ which are obtained immediately after the start of the purge are stored in a data area of a memory 53 in the RAM 33 as learning coefficient $K_{LM}$. Immediately after the purge start, the learning coefficient is not yet rewritten based on the rich mixture due to the purge. Consequently, the coefficient $K_{LM}$ is not affected by the rich mixture. On the other hand, during the purge, the learning coefficients $K_L$ are monitored by the storing section 52 to determine whether the value of the coefficient $K_L$ being stored is changed in the lean direction more than X% (for example 20%) from the reference value (1) within a predetermined time $TIM_O$ since the start of the purge, and whether the number of the coefficient $K_L$ exceeds a predetermined number $NA_O$ example 60%) For example, if more than 60% of the coefficients K in the table 50 decreased from the value 1 by 20% within 30 seconds, it is determined that a large quantity of fuel vapor had been purged. When the purge is cut off after such a purge, the lean-shifted learning coefficients $K_L'$ are rewritten with the learning coefficient $K_{LM}$ stored in the memory 53 which are not affected by the purge.

To the contrary, when the quantity of purged fuel vapor is small, namely when the decrement of the coefficient $K_L$ is less than X% or the number (NA) of the lean-shifted coefficient $K_L'$ is smaller than the predetermined number $NA_O$, the ordinary learning operation is continued without updating the coefficient.

When deriving the learning control coefficient $K_L$ from the table 50, if the detected engine load L and engine speed N do not coincide with the set values in the table coefficient $K_L$ is obtained by linear interpolation. p The learning coefficient $K_L$ is applied to an injection pulse width calculator 54 where fuel injection pulse width $T_i$ is calculated based on the basic injection pulse width $T_P$ and coefficients $\alpha$, COEF and $K_L$ as follows.

$$T_i = T_P \times \alpha \times \text{COEF} \times K_L + T_s$$

The pulse width $T_i$ is fed to the injector 11 through a driver 55 to inject the fuel.

Figure 6:
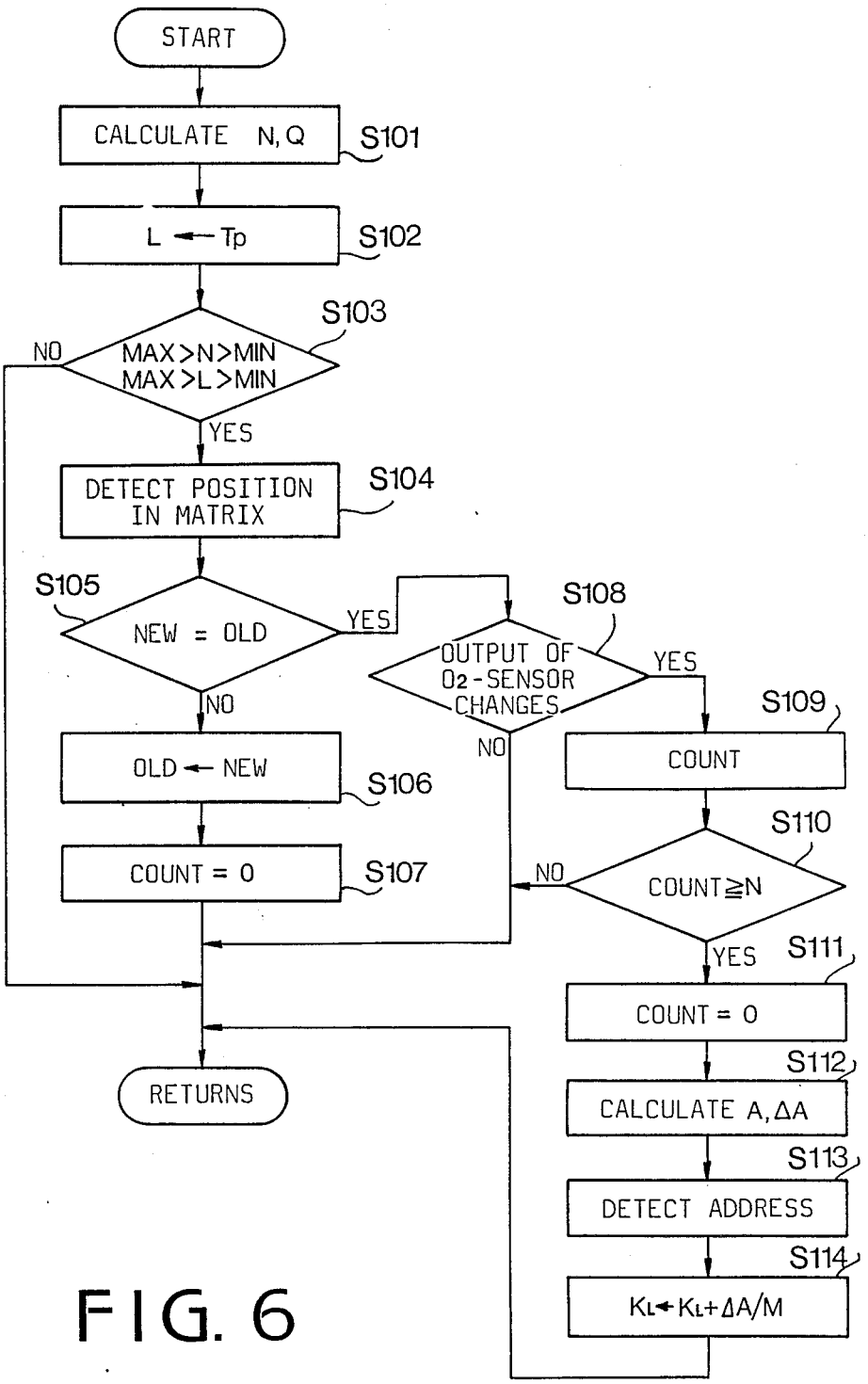
FIG. 6 is a flowchart showing the learning operation of the system.
Figure 7A:
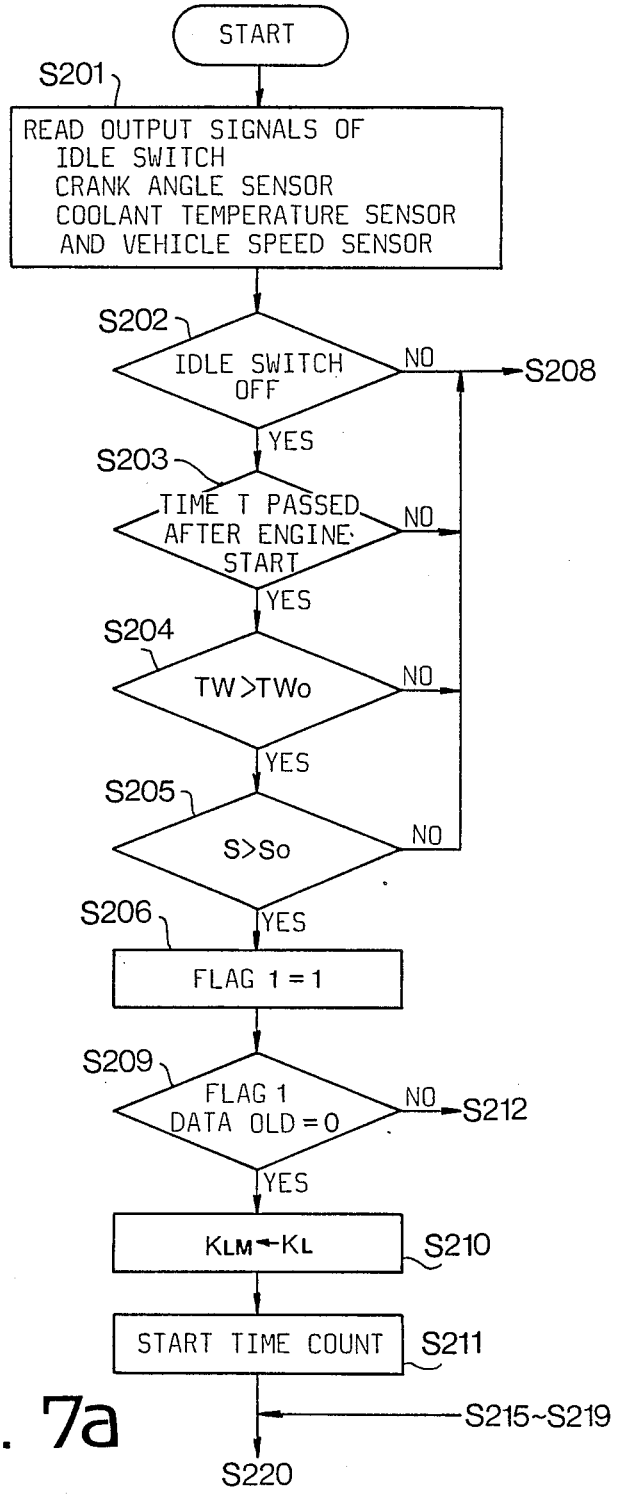
FIGS. 7*a* to 7*c* show a flowchart explaining the air-fuel ratio control operation of the system.
Figure 7B:
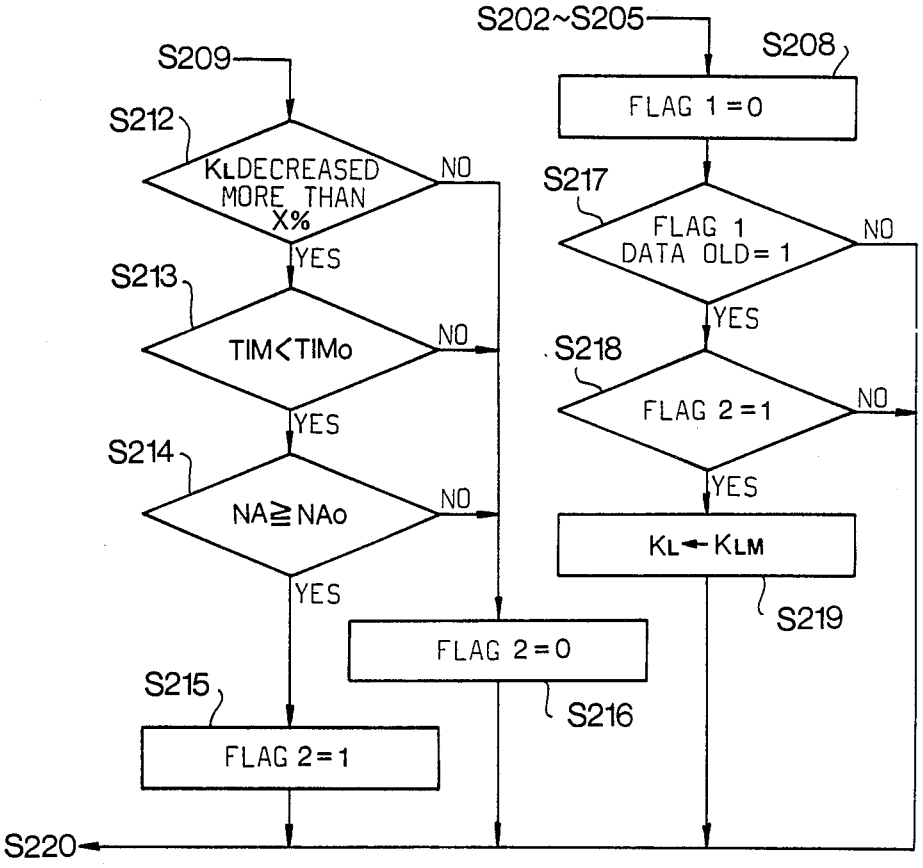
Figure 7C:
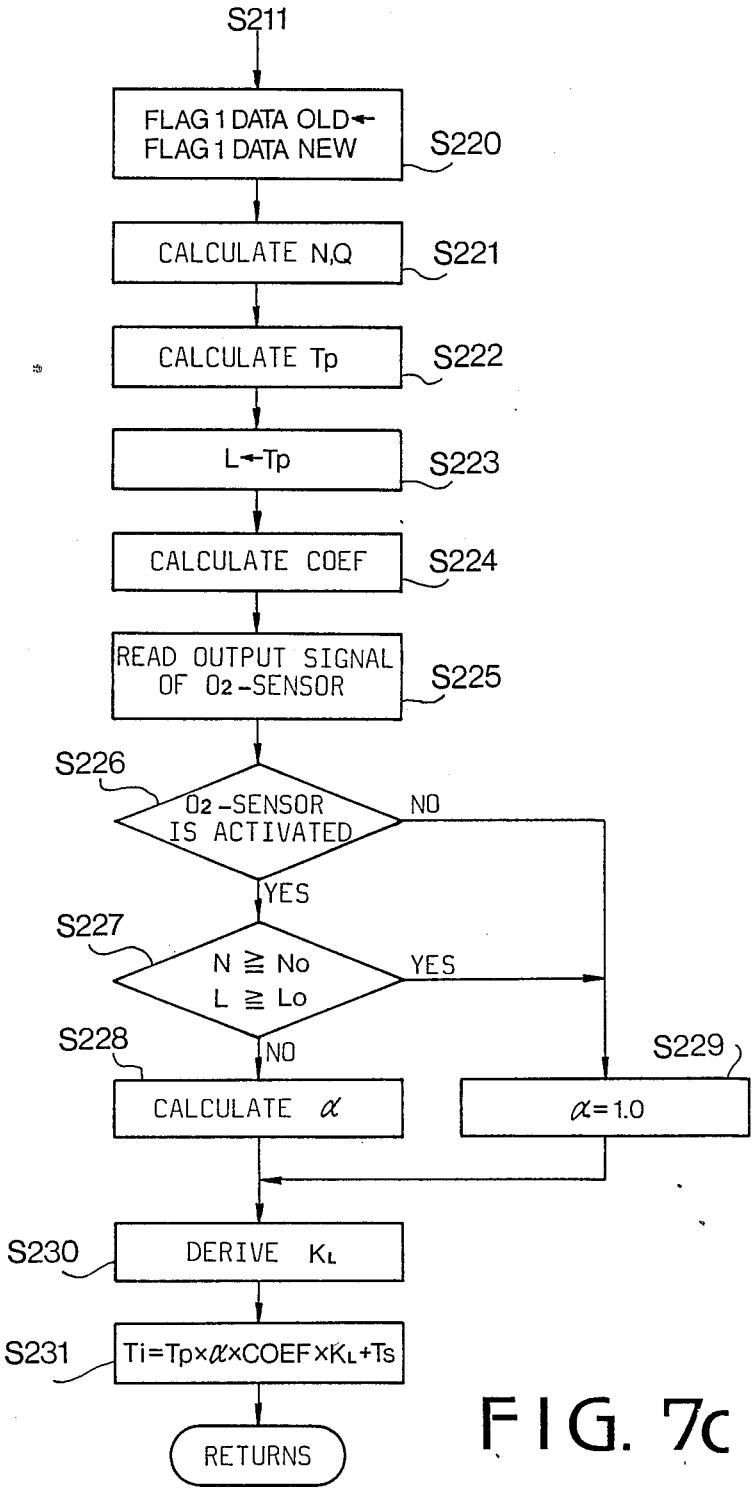

The operation of the system will be described in more detail with reference to FIGS. 6 and *7a* to *7c*. Referring to FIG. 6, the learning program is started at a predetermined interval (40ms).

Figure 4:
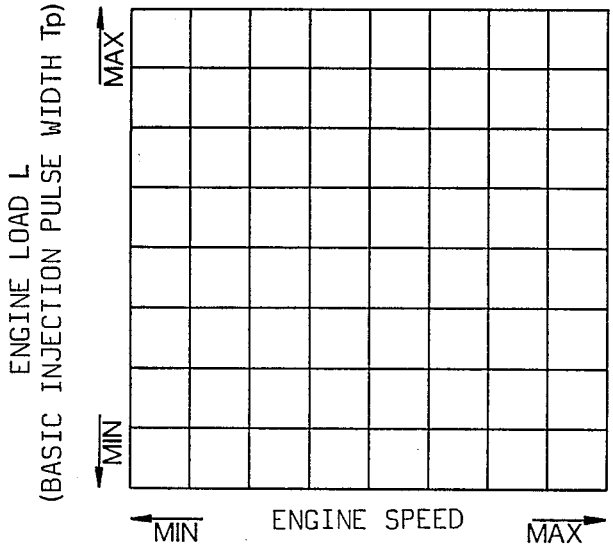
FIG. 4 shows a table for learning control coefficients.

At a step S101, the engine speed N and the intake air quantity Q are calculated and at a step S102, the basic injection pulse width is calculated as engine load L. If the engine speed and the engine load are within the range of parameters of the learning coefficient table 50, the program proceeds from a step S103 to a step S104. If either of the engine speed or the engine load is out of the range, the program exits the routine At a step S104, the position of division corresponding to the engine operating condition represented by engine speed and engine load is decided in the matrix shown in FIG. 4. The program advances to a step S105, where the decided position of division is compared with the division which has been detected at the last learning. If the position of division in the matrix is the same as the last learning, it is determined that the engine is in a steady state. The program proceeds to a step S108, where the output voltage of $O_2$-sensor 23 is detected If the voltage changes from rich to lean and vice versa, the program goes to a step S109, and if not, the program terminates. At the step S109, the number of the cycle of the output voltage is counted by a counter. If the counter counts up to n, for example three, the program proceeds to a step S111 from a step S110. If the count does not reach three, the program terminates. At the step Slll, the counter is cleared and the program proceeds to a step S112.

On the other hand, if the position of the division is not the same as the last learning, it is determined that the engine operation is in a transient state. The program proceeds to a step S106, where the old data of the position is substituted with the new data. At the step S106, the position of division detected at the step S104 is stored in RAM 33. At a step S107, the counter which has operated at step 108 in the last learning is cleared At a step S112, arithmetical average A of maximum and minimum values of the integral of the output voltage of the $O_2$-sensor at the third cycle of the output wave form and the difference $\Delta A$ between the average A and the reference value $\alpha\lambda$ are calculated. Thereafter, the program proceeds to a step S113, where the address corresponding to the position of division is detected. At a step S114, the learning coefficient $K_l$ is updated by adding or substructing the minimum value $\Delta A/M$ to or from the learning coefficient $K_L$.

The operation of the system for controlling the air-fuel ratio is described hereinafter with reference to FIGS. *7a* to *7c*.

At a step S201, output signals of the idle switch 10, crank angle sensor 20, coolant temperature sensor 21 and vehicle speed sensor are read. At a steps S202 to S205, it is determined whether the engine operation is under conditions for purging the canister. More particularly, it is determined whether the idle switch 10 is turned off (step S202), whether the predetermined time T has passed since the start of the engine (step S203), whether the coolant temperature $T_W$ is higher than the reference temperature $T_{tw}$ (step S204), and whether the vehicle speed S is higher than the reference speed $S_O$ (step S205). If the engine operation fulfills all of the above conditions, the program proceeds to a step S206, and if not to a step S208. In the routines during cold engine, the program goes to the step S208 so that the purge of fuel vapor is not yet started. Accordingly, unstabilization of engine speed at cold engine or stall of the engine caused by overrich air-fuel ratio immediately after the start of the engine do not occur.

At the step S206, a purge flag 1 is set so that the solenoid 18e of the solenoid operated valve 18 is energized to purge the fuel vapor. At a step S209, data on the flag 1 at the last routine (FLAG 1 DATA OLD) which is stored in the RAM 33 is monitored. When the flag data has not been set, the present routine is assumed to be the first routine after the start of the purge and the program proceeds to a step S210. At the step S210, the learning coefficients $K_L$ stored in the table 50 immediately after the purging are stored in the memory 53 in the RAM 33. At a step S211, count of time TIM after the start of the purge is started. Thereafter, the program goes to a step S220 to execute learning.

At the step S220, the last flag 1 data in the RAM 33 is rewritten with the present flag 1 data Namely, in the present routine, the data that flag 1 is set is stored in the RAM 33. At a step S221, the engine speed N, and intake air quantity Q are calculated and at a step S222 the basic injection pulse width $T_P$ is calculated based on the calculated engine speed N and air quantity Q. At a step S223, the pulse width $T_P$ is determined as the engine load L. The miscellaneous coefficient COEF is calculated dependent on the output signals of the throttle position sensor 9, idle switch 10, coolant temperature sensor 21 at a step S224. At steps S225 and S226, the feedback signal $\lambda$ from the $O_2$-sensor 23 is read and it is determined whether the $O_2$-sensor is activated. If the $O_2$-sensor 23 is not activated, the program goes to a step S229 where the feedback coefficient $\alpha$ is set to 1 and the program goes to a step S230. When the $O_2$-sensor 23 is activated, it is determined whether the engine speed N and the engine load L are within the feedback control range at the step S227 When the engine speed and load are in the range, the air-fuel ratio correcting coefficient $\alpha$ is calculated. At the step S230, the learning coefficient $K_l$ is derived from the table 50 in the RAM 34 At a step S231, the fuel injection pulse width $T_i$ is calculated using the learning coefficient $K_L$, and the pulse width signal is applied to the injector 11, so that fuel is injected at the predetermined timing.

When it is determined at step S209 that the flag 1 data was set at the last routine, which means that the purge has continued for some time, the rewritten learning coefficients $K_L'$ in the table 50 are monitored at steps S212 to S214. At the step S212, it is determined whether the learning coefficients have decreased more than X%. At the step S213, the time count which started at the start of the purge, is compared with the predetermined reference time count $TIM_O$. At the step S214, number NA of the divisions having coefficients which decreased more than X% is compared with the reference number $NA_O$. If the decrease of the coefficients $K_l$ is more than X%, and the count is smaller than $TIM_O$ ($TIM \leqq TIM_O$) and the number NA of the divisions is larger than $NA_O$ ($NA \geqq NA_O$), the program goes to a step S215 where a flag 2 is set.

To the contrary, when one of answers at steps S212 to S214 is NO, the program goes to a step S216 to reset the flag 2. Thereafter, the program proceeds to the step S220.

When the engine operation is not under the conditions for purging the fuel, the flag 1 is reset at the step S208, thereby de-energizing the solenoid 18*e*Consequently, the solenoid operated control valve 18 is closed to interrupt the purge.

At a step S217, the flag 1 data at the last routine is derived from the RAM 33. When the flag 1 data was not set at the last routine, the interruption of the purge is continued and the program goes to the step S220 for learning. On the other hand, if the flag 1 data had been set at the last routine, it indicates that the present routine is the first routine after the purge is interrupted. At a step S218, it is determined whether the flag 2 is set, namely whether a large quantity of fuel vapor had been purged prior to the interruption. When the flag 2 is set, the learning coefficients $K_L'$ are rewritten with the learning coefficients $K_{LM}$ stored in the RAM 33 at the step S210 in the routine immediately after the purge. Thereafter, the program goes to the step S220 where the flag 1 data is stored in the RAM 33. Thereafter, the learning is carried out. In the present routine, since the learning coefficients which are not affected by the purge are derived at the step S230, the air-fuel ratio is prevented from becoming excessively lean.

When it is determined at the step S217 that the flag 1 data had not been set at the last routine, which means that the interruption of purge is continued, or at the step S218 that the flag 2 had not been set at the last routine, the program goes directly to the step S220. Thereafter, the learning operation is completed for a relatively short time.

Figure 8:
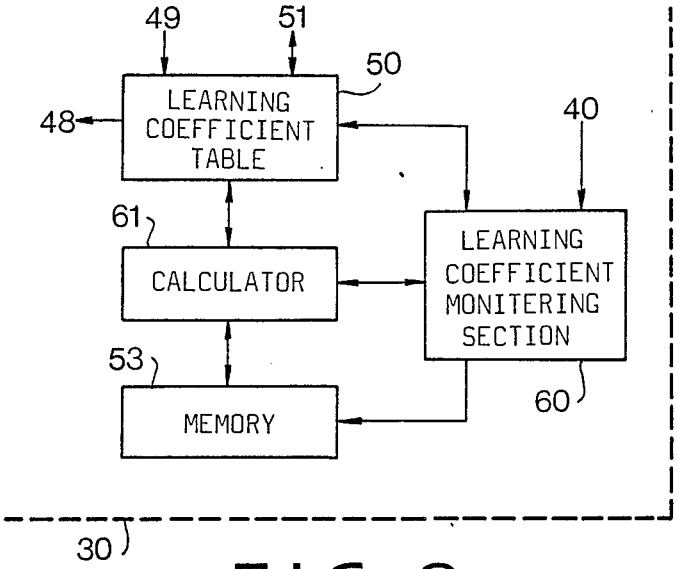
FIG. 8 is a block diagram showing a part of a control unit in a second embodiment of the present invention.
Figure 9:
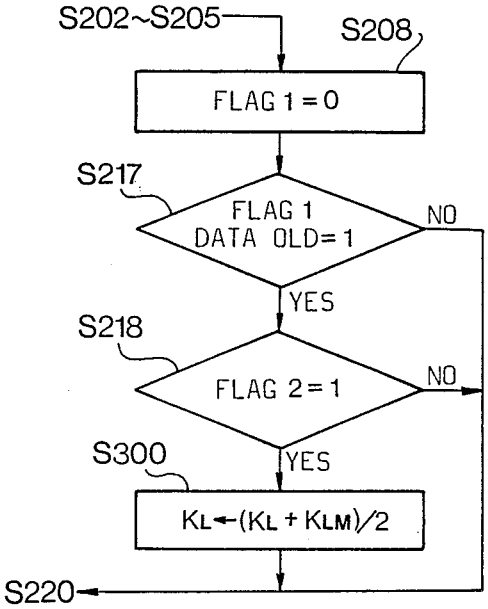
FIG. 9 shows a part of a flowchart explaining the operation of the second embodiment.

Referring to FIG. 8, a control unit of a second embodiment of the present invention has a learning coefficient monitoring section 60 and a calculator 61 instead of the learning coefficient storing section 52 of the first embodiment. When the monitoring section 60 is fed with the canister purge signal from the purge determining section 40, the learning coefficient $K_L$ which is not yet affected by the purge is stored in a data area in the RAM 33 as $K_{LM}$. During the purge, the learning coefficients $K_l$ are monitored in the section 60. If the coefficient is updated more than X% with respect to the reference value 1, and the number NA of divisions each storing coefficient updated more than X% exceeds $NA_O$ within the time $TIM_O$, a calculation signal is fed to the calculator 61. The calculator 61 calculates an average of coefficients $K_{LM}$ stored in the RAM 33 and coefficients $K_L$. The coefficients $K_L$ stored at corresponding addresses of the table 50 in the RAM 34 are rewritten. Accordingly, as shown in FIG. 9, when it is determined at the step S218 that the flag 2 is set, the program goes to a step S300 where the average is calculated and the learning coefficients stored in the table 50 are rewritten with the averages. Other constructions and operations are the same as those of the first embodiment. Thus, in the present embodiment, fluctuation of the air-fuel ratio which is caused by a response delay of the control valve 18 at the purge cut-off is prevented.

Thus, in accordance with the present invention, the system controls air-fuel ratio after the cutting of the purge with data stored in a memory having a small capacity, whereby the system can be simplified in construction and reduced in size.

While the presently referred embodiments of the present invention have been shown and described, it is to be understood that these disclosures are for the purpose of illustration and that various changes and modifications may be made without departing from the scope of the invention as set forth in the appended claims.

What is claimed is:

1. An air-fuel ratio control system for an automotive engine, the engine having a purge system for purging fuel vapor in a canister to an intake passage of the engine, and a learning control system having a first memory storing a plurality of learning coefficients which are used for determining air-fuel ratio of a mixture and updating means for updating the learning coefficients with change of characteristics of elements of the engine, the system comprising:

first detector means for detecting a start and a stop of the purging of the fuel vapor and for producing a purge start signal and a purge cut signal respectively;

storing means responsive to the purge start signal for storing the learning coefficients stored in the first memory in a second memory as updating coefficients;

second detector means responsive to the purge start signal for detecting a large amount of purged fuel vapor and for producing an updating signal; and updating means responsive to the purge cut signal and to the updating signal for updating the learning coefficients in the first memory with the updating coefficients in the second memory.

2. The system according to claim 1 wherein the learning coefficient is updated with an average of a learning coefficient in first memory and an updating coefficient in the second memory.

3. The system according to claim 1 wherein:

the second detector means detects a large deviation of the learning coefficient in the first memory.

* * * * *